United States Patent [19]

Waid et al.

[11] 4,410,369

[45] Oct. 18, 1983

[54] MANUFACTURE OF ELECTRICALLY WELDED STEEL PIPE

[75] Inventors: George M. Waid, Burton; Joseph E. Franklin, Medina; Dionisyj W. Demianczuk, Parma, all of Ohio

[73] Assignee: Republic Steel Corporation, Cleveland, Ohio

[21] Appl. No.: 216,012

[22] Filed: Dec. 12, 1980

[51] Int. Cl.[3] ..... C21D 8/10

[52] U.S. Cl. ..... 148/2; 148/12 F; 148/39

[58] Field of Search ..... 148/2, 39, 12 F; 75/53, 75/58

[56] References Cited

U.S. PATENT DOCUMENTS 3,725,049 4/1973 Satoh et al. ..... 75/123 D 4,143,211 3/1979 Obinata et al. ..... 75/53

*Primary Examiner*—Peter K. Skiff

*Attorney, Agent, or Firm*—Cooper, Dunham, Clark, Griffin & Moran

[57] ABSTRACT

For skelp to make pipe having a seam butt-joined as by electrical resistance or submerged arc welding, skelp is made by pouring a base melt of rimming steel into an ingot mold to about 80 to 95% full and then after a shell of rimmed steel has solidified against the mold wall, completing pouring of the same melt while adding further material to the molten core, e.g. more C or Mn, and Al or the like for killing, so that the solidified ingot has a core of desired high strength, killed or semi-killed steel. The ingot is processed to desired skelp by hot rolling, the top and bottom regions being suitably cropped, so that the skelp has a main body of the high strength steel, bordered lengthwise by integral edge zones, e.g. ½ inch or more wide, of the rimmed steel, free of unwanted inclusions. When rolled to pipe shape, with finished edges, the edge zones are electrically butt welded, such operation being effected with unusual facility. In the completed pipe, the weld region is relatively free of oxide or like inclusions, and thus not susceptible of rejection for defects at or about the seam, while the pipe is essentially characterized by high wall strength.

7 Claims, 8 Drawing Figures

MANUFACTURE OF ELECTRICALLY WELDED STEEL PIPE

BACKGROUND OF THE INVENTION

This invention relates to the manufacture of electrically welded, tubular, steel products such as steel pipe having a longitudinal seam which is butt joined by electrical resistance welding, submerged arc welding or the like. Steel pipe is commonly made from heavy strip or plate of hot-rolled steel, called skelp, provided in long pieces or coiled lengths, which have their longitudinal edges finished appropriately for butt welding together when the skelp is brought into a cylindrical configuration. Such shaping of the skelp into tubular form is achieved by suitable roll means, such as successive concave rolls past which the skelp is advanced while the rolls progressively bend it about the longitudinal axis intended for the tube, or in the case of very large diameter pipe (e.g. about 25 inches or more in diameter) means such as a stand of long, heavy rolls on axes parallel to the desired pipe axis, which bend an entire length of partly bent, sidewise-received skelp into the intended shape.

In these or other ways, the skelp is brought, progressively or as a complete piece, into a cylindrical form, with a narrow, longitudinal cleft between the original skelp edges. Then further rolls or other means compress the outside of the pipe blank to close the cleft, at least as it passes or is passed by the welding means, which welds the butted edges together. For large diameter pipe, such electrical welding may be of the submerged arc type, on the outside of the cleft, with a second, subsequent weld by another consumable electrode along the inside. For a great many sizes of pipe, particularly under 25 inches, electrical resistance welding is used, by allowing electric current to pass through the abutted skelp edges successively along the cleft zone; the junction provides a high resistance, generating sufficient heat to melt the adjacent steel and form the desired weld.

Welded pipe of these types is rigorously tested along the weld zone, by non-destructive testing techniques such as using suitable radiation to detect imperfections, particularly in the welded metal. It has been found that an undesirably high percentage of pipe lengths are rejected in the tests, and that such rejections are often caused by non-metallic inclusions in the steel, such as oxide stringers resulting from deoxidation practice with aluminum or silicon, e.g. in semi-killing or killing techniques desired for other advantage in the steel. Because of such inclusions, as of aluminum oxide, and indeed because of other compositional requirements, the butted edges of steel are more difficult to weld than might be the case with simple, rimmed steel; yet strength requirements for the pipe have dictated the use of steels which have contents of carbon, manganese, silicon, or others, or are killed or grain-refined with aluminum, such that difficulty is encountered in welding the pipe, because of non-metallic, oxide inclusions, or for other known reasons. As will be understood, the main body of the pipe wall of such steels may be deemed entirely sound despite inclusions, but if the weld is imperfect, the pipe must be rejected.

SUMMARY OF THE INVENTION

For the production of steel pipe having a longitudinal weld zone less susceptible of defects such as described above, the invention involves first making skelp having along each of its longitudinal edges an integral, narrow zone of steel which is relatively uncontaminated with inclusions and which is preferably more readily weldable than, for example, the type of steel that is normally used for tubular products. At the same time the main body of the skelp preferably consists of steel of the last-mentioned type, e.g. having a content of carbon and if desired, of manganese and/or silicon, or even of special strengthening elements such as columbium and/or vanadium, plus aluminum for killing, such being steel known to be compositionally suited for the mechanical properties of strength, toughness and hardness required for pipe but incapable of constituting rimming steel that is comparatively free of non-metallic inclusions and is easy to weld.

An important part of the method of making tubular steel products according to the invention resides in producing the above-described skelp in the following manner: A melt of steel is prepared in conventional manner, as by a so-called basic oxygen technique, so as to have a non-killed, rimming character, as might be represented by 0.01 to 0.12% carbon, 0.2 to 0.6% manganese, balance iron and incidental elements (all percentages herein being by weight). The molten steel is teemed into an ingot mold, to about 80 to 95% full, and pouring is interrupted for about 1 to 15 minutes, advantageously for 3 to 6 minutes, while rimming action, including the usual effervescence, proceeds, and while a moderately thick skin or shell of steel solidifies against the inside of the mold wall. Then teeming of steel, i.e. from the same melt in the ladle, is resumed into the mold, filling it. At the same time further elements are added to the molten core in the mold, conveniently by injecting them, as small solid pieces (say, about ¼ inch) into the falling stream of molten steel from the ladle. Such addition may include one or more of carbon, manganese, e.g. as ferromanganese, silicon if desired (as ferro-silicon), aluminum if a killed product is sought, and small amounts of elements such as columbium, vanadium and titanium for enhancing mechanical properties. The filled ingot is then allowed to solidify in conventional manner suitable to the steel now constituted in the core, so that the completed ingot consists of a core of steel having desirably higher content of such elements as carbon, manganese, silicon if wanted, and other elements as mentioned above, and may be killed by the added aluminum. This core is surrounded, for most of its length, by an integral shell or layer of rimmed steel which is essentially pure ferrite, practically free of non-metallic inclusions.

In continuing the method of the invention, the completed ingot is converted to skelp by suitable hot rolling, during the course of which the top end of the ingot, above the rimmed shell, is removed and preferably also the bottom layer of rimmed steel. The deformation by hot rolling is advantageously directed to process the ingot through successive stages of slab and plate, ultimately reaching a flat, skelp product of desired length and breadth, having the selected thickness for the ultimate pipe to be made. The effect of these operations is that the long edges of the skelp have been developed from the narrower sides of the ingot and each embodies the layer of rimmed steel which was there formed as above described and which has now been stretched longitudinally along the entire length of the skelp, and correspondingly otherwise shaped by the hot rolling, so as to constitute an integrally attached edge zone at each edge of the skelp which has the stated ferritic, inclusion-free composition.

The so-produced skelp is next converted to the desired tubular product, i.e. steel pipe, by suitable, known operations. Thus the edges of the skelp are trimmed as necessary, e.g. to provide the usual squared-off edges at the correct angle for full abutment when the material is shaped to the needed cylindrical contour and held for welding. As will be understood, such trimming need not be more than is necessary for the ultimate tight fit of the butted edges, and therefore may leave an ample band or zone for welding, without significant intrusion into or melting of the core metal that constitutes the body of the skelp. Welding along the closed cleft of the finished pipe blank may then proceed in conventional manner, e.g. by electrical resistance welding in the majority of cases, or by submerged arc (consumable electrode) welding in the instance of large diameter pipe.

The ultimate product is thus electrically welded pipe where the weld seam is created along the adjacent zones of essentially pure ferrite, yet fully and strongly integrated with the major extent of the pipe wall, which has the high strength and like mechanical properties, including a semi-killed or killed condition, commonly specified for tubular products of steel. Although it may theoretically seem that the rimmed steel at the weld zone might have a somewhat lower strength than the remainder of the pipe wall, such effect appears negligible, because the rimmed zone is relatively very narrow and has undergone a heat treatment as a result of the welding operation. The actual weld, moreover, appears inherently better and more secure (as well as being easier to accomplish) than prior welding of the usual semi-killed or killed skelp; it can exhibit a more uniform microstructure and relatively complete freedom from non-metallic (e.g. oxide) inclusions or other imperfections which have caused rejection of pipe heretofore for poor quality at the critical weld zone.

In consequence, pipe made according to the invention as described above is unusually satisfactory. It not only has the full strength of its wall as required by conventional specifications, i.e. to withstand high internal pressure of the contained fluid, but also is remarkably sound along the butt-welded zone both in fact and so as to obviate frequent rejection upon the usual non-destructive testing. Further features and details of the invention are set forth in the description hereinbelow, in relation to an illustrative example set forth in the accompanying drawing.

DETAILED DESCRIPTION

Figure 1:
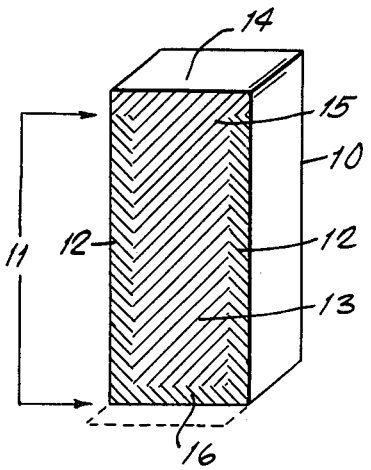
FIG. 1 is a perspective, simplified view of an ingot cast according to the invention, in vertical section along a plane near but parallel to a wider side face.

In FIG. 1, the ingot 10 is cast in a generally rectangular mold, using a steel composition that is advantageously of rimming character, and with teeming of the molten steel temporarily interrupted after the mold has been filled to a height 11, being from 80% to 95% full, for example 90% full. The ingot mold is allowed to rest for up to 15 minutes, for instance 4 to 6 minutes, while rimming action proceeds, including the usual effervescence, and while a layer or shell 12 (thus of rimmed steel) solidifies against the mold wall. The core 13 remains molten, whereupon pouring is continued from the same ladle (not shown) so that the ingot 10 is completed to its top 14. While this pouring is thus completed, there is introduced into the teemed stream of steel such further elements or quantities of elements as are desired for the composition of the ultimate pipe body, e.g. carbon, manganese, aluminum (as for killing), possibly silicon and microalloying elements of the class of columbium, vanadium and titanium.

After completion of such filling, herein called back-filling, the core metal 13 and the top part 15 of the ingot have the desired ultimate composition, which will usually be killed or semi-killed and non-rimming, with the content of carbon, manganese and other elements most suitable for the pipe to be made. The ingot is then allowed to solidify, and treated at such time and immediately after, as killed or semi-killed steel, and eventually processed by hot rolling with techniques appropriate to the killed or semi-killed and other compositional nature of the core. As will be understood, the added elements are advantageously added in solid form, e.g. particles of about ¼ inch size or less; carbon can be pure carbon or graphite or a C-Mn or Fe-C alloy, while manganese can be added as such, or as ferro-manganese, and other elements can be presented in any suitable form (for instance aluminum metal as such), and the addition can be a mixture of different particles or as pieces of a pre-constituted mass of all desired elements. Suitable techniques and devices are known for feeding particles, granules or other pieces of solid metals or alloys into a falling stream of molten steel, e.g. which is being teemed from a ladle; the chief purpose here is to commence the injection, preferably, right after back-filling begins and to get the material all injected not later than the end of teeming.

It will be understood that in casting successive ingots from a ladle of steel, after the partial filling of a first ingot mold, the ladle may be advanced to one or more succeeding molds, for the same partial filling of 80 to 95%, and then returned for the described back-filling (and injection of additional material) of the earlier mold or molds while the later mold or molds are waiting; the method can thus be managed, for each 2 or 3 molds, to save time and to help keep the ladle metal molten at high temperature. Indeed, the molten steel in the ladle is preferably produced and there held at as high a temperature as is consistent with good metallurgical practice. If desired, suitable technique may be employed to retard solidification of the molten steel remaining in each mold at the end of back-filling, for instance by applying topping compound or by employing a so-called hot top; in the latter event, the first or partial filling should be interrupted at or below the lower boundary of such structure.

Figure 2:
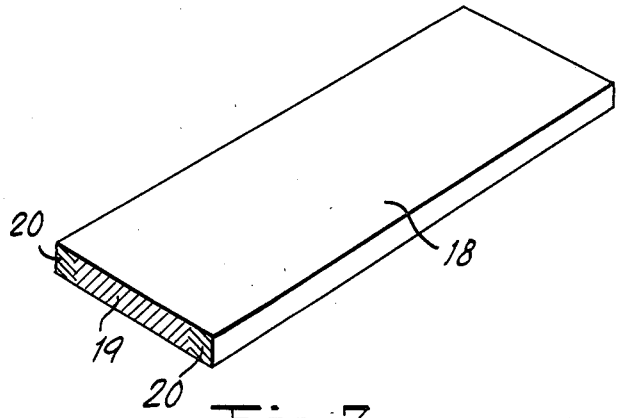
FIG. 2 is a perspective view of a slab suitable for making skelp and developed by hot rolling from the ingot of FIG. 1, it being understood that all figures are essentially schematic and are not drawn to scale nor even to approximately the same scale as each other.
Figure 3:
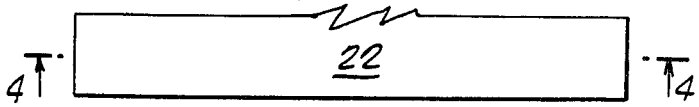
FIGS. 3 and 4 are respectively a fragmentary face view and a transverse section of skelp produced from the slab of FIG. 2.
Figure 4:
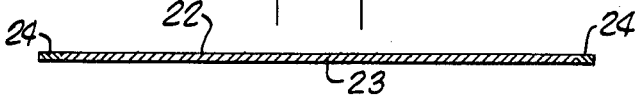

As indicated above, each ingot 10 produced in the described way, i.e. with partial filling and delayed back-filling, is handled in conventional manner, being hot rolled to bloom and then to slab 18 (FIG. 2); the end portion of the slab corresponding to the uppermost part 15 of the ingot, above the distance 11, and likewise the other end portion corresponding to the bottom zone 16, i.e. of the rimmed shell, of the ingot are both cropped. The slab 18 thus consists of a wide center part 19 derived from the core 13 and bordered by integral narrow zones 20 of the rimmed steel originally constituted by the side zones 12 of the ingot. Thereafter the slab 18 can be further hot rolled to the plate-like (or strip) form of the skelp 22 (FIGS. 3 and 4), again having a very wide center portion 23 of steel of strength desired for the pipe body, with bordering edge zones 24 of the rimmed composition, which are essentially pure ferrite, free of troublesome inclusions and very readily weldable.

Figure 5:
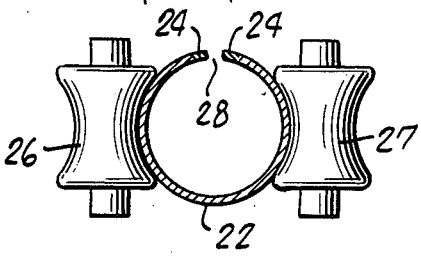
FIG. 5 is a view, with the skelp in cross section of a step in the rolling of the skelp into cylindrical shape.
Figure 6:
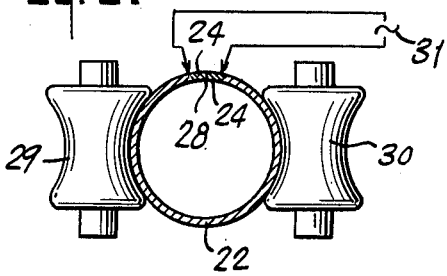
FIG. 6 is a view, electrically diagrammatic, of the skelp of FIG. 5 being welded along its cleft while such cleft is held closed by suitable rolls.
Figure 7:
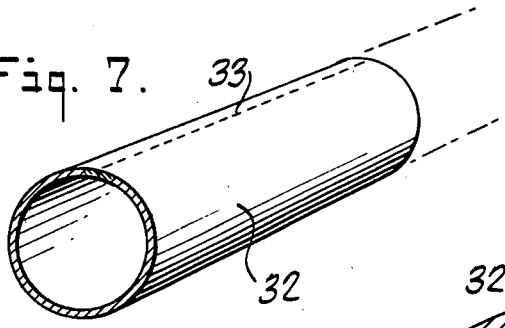
FIG. 7 is a perspective view, with one end in cross section, of completed, welded pipe.
Figure 8:
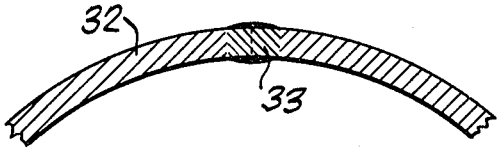
FIG. 8 is an enlarged, fragmentary transverse section showing the welded zone of the pipe of FIG. 7.

As will be understood, the finished skelp will have its longitudinal edges, i.e. the outer edges of the zones 24, trimmed to provide faces which will mate squarely when the material is brought to cylindrical shape for making pipe. A late stage in one sequence of such operation is shown in FIG. 5, where the skelp 22 is brought to essentially final, cylindrical configuration on passing between concave rolls 26,27 so that the cleft 28 between the longitudinal edge zones is brought toward closed condition. Closure of the cleft 28 is shown completed, and as held closed by rolls 29,30, in FIG. 6, where welding is effected by passing electric current from a source 31 across the zone of the cleft line 28. Since the abutting edges of the skelp exhibit a moderately high resistance (but not as high as the longer path around the skelp body), sufficient heat is generated to melt the steel adequately for welding. The finished pipe 32 is shown in FIG. 7, where the cleft line has become a welded seam 33, as also illustrated in FIG. 8, where the weld zone of the seam 33 may be seen to occupy, if desired (although not necessarily), all or almost all of the total width of the two narrow, ferrite zones 24 at the longitudinal edges of the skelp.

The production of pipe in the described manner is notably advantageous because of the better weldability of the skelp; as explained, the edge zones 24 are derived from rimmed steel and are essentially pure ferrite, substantially free of inclusions which might interfere with electrical welding or which might lead to rejection of the finished pipe because of objectionable stringers or the like. At the same time the main body of the pipe has sufficiently high strength, toughness and other mechanical properties to suit rigid requirements, by reason of its composition as to carbon and other elements (including aluminum, for example, for killing); while the weld zone may lack such special content of elements other than iron, there is really no loss of strength in the finished pipe, because this zone of the skelp edge parts 24 is relatively very narrow, and is in effect usefully heat treated by the welding operation itself.

As will be understood, welded pipe of a wide variety of sizes can be made according to the invention, e.g. from diameters (inside) of the order of one inch, to large values over 25 inches, up to 36 inches or more. In each case, of course, the skelp is developed, by rolling, from the original ingot, to have the requisite width, including the relatively narrow edge zones originated by the rimmed zones at opposite sides of the ingot.

In preparing the ingot 10 according to the described method, the first-solidified zone or shell 12, of rimmed steel, may be 1 or 2 inches thick, and more generally in the range of $\frac{3}{4}$ to 4 inches. As will be understood, the ingot itself may be of any desired size, the foregoing thickness of the ferrite layer being considered for an ingot of horizontal dimensions of 31 inches by 55 inches or thereabouts, and a height of 86 inches to 110 inches. After the ingot has been hot-rolled to the form of slab 18, with suitable cropping, and as developed in the form of the skelp 22 having the desired width for the circumference of pipe to be made, the integrally connected edge zones 24 may each have a width of, say, 1 to 4 inches as first produced. These edges of the skelp are then trimmed, as is conventional for making pipe, the present preference being that the final width of each edge zone 24 be in the neighborhood of $\frac{1}{2}$ to 1 inch. As will be understood, these dimensions are not necessarily limits but may be varied or exceeded as circumstances may demand.

The base melt of steel, for example as held in the ladle from which molten steel is teemed into the mold, may consist of a composition containing 0.01 to 0.15% carbon, 0.2 to 1.0% manganese, balance iron and incidental elements, it being understood that the limits of carbon and manganese are selected so that the steel is of rimming character and will exhibit the usual effervescence (as teemed into the mold). As an example, such steel can have 0.06% carbon and 0.5% manganese; such composition then characterizes the first-solidified outer zones 12,16 of the partially-poured ingot.

In the second stage of pouring, material is added to the falling stream of steel so as to convert the molten core of the ingot into the desired high-strength composition for the ultimate pipe. In a generic sense, the final core composition may be 0.05 to 0.40% carbon, 0.5 to 1.5% manganese, 0 to 0.5% silicon, 0 to 0.1% columbium, 0 to 0.2% vanadium and 0 to 0.25% titanium, with aluminum in an amount suitable for providing a killed or semi-killed steel (or otherwise for grain refinement), such additions being made to the descending stream of molten metal as has been explained.

It will be understood that the ultimate composition of the ingot core, and thus of the body of the skelp and pipe, may be as known and desired for such pipe; for convenience, reference to added materials can be expressed in the amounts of the desired, final composition in the ultimately solidifed ingot core, and thus by implication in the amounts to be added. By way of specific examples of electrical resistance welded pipe to which the invention is applicable, the following table sets forth several compositions appropriate for different sizes of pipe as there stated. The compositions are given in ranges appropriate for melt shop practice. In each case, the original melt is of a low-carbon, low-manganese chemistry as set forth hereinabove. In each of the tabulated grades, sufficient of each element is added to the final stage of pouring in order to bring the content of the entire ingot up to the values stated in this table, in the core.

TABLE 1

| Grade | C | Mn | Al | Cb | V | Pipe Size |
|---|---|---|---|---|---|---|
| X52 | 0.25<br>0.27 | 1.05<br>1.25 | 0.03 | — | 0.05 | $8\frac{5}{8}$ in. diameter and over<br>0.313 in. wall and over |
| X52 | 0.15<br>0.19 | 0.95<br>1.15 | 0.03 | 0.03<br>0.04 | — | $8\frac{5}{8}$ in. diameter and over<br>0.313 in. wall and over |

TABLE 1-continued

| Grade | C | Mn | Al | Cb | V | Pipe Size |
|---|---|---|---|---|---|---|
| X60 | 0.12/0.15 | 1.15/1.30 | 0.02/0.04 | 0.03/0.04 | 0.03/0.05 | 8⅝ in. diameter and over under 0.250 in. wall |
| X60 | 0.12/0.15 | 1.15/1.30 | 0.02/0.04 | 0.03/0.04 | — | 8⅝ in. diameter and over over 0.250 in. wall |

As will be understood, these are all aluminum-killed steel (in the body portion). For that purpose, aluminum is added to bring its content to 0.02 to 0.2%, all being sufficient for killing. If other function of aluminum is required, larger amounts can be included as up to a total of 0.5% in the ingot core.

Skelp and pipe made according to the present invention will be found to have good strength, with a secure welded seam of desirable strength, e.g. resistance to high internal pressure of fluid in the pipe. The product is remarkably free of inclusions along the welded cleft; it is correspondingly unlikely to be rejected because of defects of this or other nature in the weld zone.

As will be understood, to cover the above-indicated range of pipe sizes, the skelp 22 may have a width ranging from 3 to 115 inches or more, and thickness as suitable for the desired pipe diameter, e.g. from 0.1 to 0.5 inch; thus for example, the invention is notably suitable to make pipe of 5 to 12 inches diameter, with a wall of 0.15 to 0.35 inch. In all cases, the hot rolling to convert the ingot to skelp is suitably managed and controlled so that the edge zones 24 from the layers 12 of original steel are kept at sufficient width to provide areas for the ultimate weld of pipe. Most advantageously, the main body 24 of the skelp is aluminum killed, including aluminum in the range of 0.02 to 0.12%.

It should be here noted that in the prior art and in certain recent inventions, it has been proposed to follow an ingot casting technique in which a base melt of steel is first poured into an ingot mold to 80 to 95% full, and then after a shell or layer of the base melt has solidified against the mold wall, the mold is back-filled while adding other material to modify the base core metal, sometimes comprising aluminum for killing where the base melt was rimming steel. The purpose and effect of these operations has been to afford products, such as hot rolled plate, bar and strip, and also cold rolled strip, having its principal surface covered with a thin skin, of the order of hundredths or thousandths of an inch thick, constituted by the base steel, and thus to obviate surface problems otherwise presented by the core metal.

In such prior operations, the only thought has been to provide a special surface, advantageously very thin, for the broad face areas of the product—as to afford an unblemished face or appearance, e.g. for subsequent painting or plating, or to avoid minute surface cracks that can lead to serious cracks on sharp bending of the product, or to avoid rolling difficulty on surfaces of phosphorus-containing steel, or for other specific problems relating to principal surfaces of such products. In all such cases, the improvement has related strictly to the broad or chief faces and has been with characteristics directly and immediately at the surface. In contrast, the skelp- and pipe-making methods of the present invention, which are not at all disclosed in the prior proposals, are concerned with a metal zone of substantial width and thickness and with what are essentially subsurface conditions, i.e. in the relatively deep regions to be affected by the momentary melting needed for the pipe-welding step. In this invention, the oxide inclusions such as caused by killing the steel are not merely masked at the surface, but are in effect wholly obviated, so as to improve materially the actual welding operation and provide the new results and advantages, described above, for the manufacture of electrically welded steel pipe.

It is to be understood that the invention is not limited to the specific steps and features herein described and shown, but may be carried out in other ways without departure from its spirit.

We claim:

1. In a method of making electrically welded pipe in which elongated steel skelp is first shaped to a cylindrical contour about its longitudinal axis and has its longitudinal edges juxtaposed to provide a cleft for butt welding, and thereafter said edges are butt welded electrically together along said cleft, the procedure of making such skelp and pipe therefrom which comprises pouring an ingot mold 80 to 95% full of molten steel that is free of deoxidizing elements which would be sufficient to kill the steel, allowing said filling to rest while a shell of non-killed steel solidifies next to the mold wall surrounding a still-molten core, then completing pouring of said molten steel into a mold while adding to the molten steel in the mold sufficient deoxidizing material in the finished core to provide a killed or semi-killed core, said first pouring step, said resting step and said second pouring step being performed and controlled so that in the solidified ingot said non-killed shell is at least ¾ inch thick; and after solidification of the ingot, converting the same by hot rolling to elongated steel skelp of primarily killed or semi-killed character having a width of at least about 3 inches and along each of its longitudinal edges an integral zone of non-killed steel at least ½ inch wide, finishing each edge zone to a shape at least ½ inch wide, for butt welding, and completing making the pipe by shaping the skelp to cylindrical contour and electrically butt welding said edge zones together.

2. A method as defined in claim 1 in which the deoxidizing material added to the molten core comprises aluminum added in sufficient amount for 0.02 to 0.20% in the finished core, to kill the steel thereof.

3. A method as defined in claim 1 in which the said first-mentioned molten steel contains not more than 0.15% C and not more than 1.0% Mn, and is a rimming composition, said first-mentioned molten steel in the mold undergoing rimming action while resting before completion of pouring, and said non-killed steel zones of said skelp consisting of rimmed steel which is essentially ferrite, said electrical welding of said skelp edges being effected in said rimmed steel zones.

4. A method as defined in claim 3, which includes modifying the composition of said molten ingot core while completing pouring into the mold, both to kill and to strengthen the steel of the core, comprising injecting into the further molten steel being poured, sufficient material of the class consisting of carbon and manganese, so that the core contains more than 0.15% C or more than 1.0% Mn, or both.

5. In a method of making electrically welded pipe in which elongated steel skelp is first shaped to a cylindrical contour about its longitudinal axis and has its longitudinal edge juxtaposed to provide a cleft for butt welding, and thereafter said edges are butt welded electrically together along said cleft, the procedure of making such skelp and pipe therefrom which comprises pouring an ingot mold 80 to 95% full of molten, rimming steel, allowing said filling to rest while a shell of rimmed steel solidifies next to the mold wall surrounding a still-molten core, then completing pouring of said molten steel into the mold while adding to the molten steel in the mold, material for killing and strengthening selected from the class consisting of aluminum, carbon manganese, columbium, vanadium and titanium, said first pouring step, said resting step and said second pouring step being performed and controlled so that in the solidified ingot said non-killed shell is at least ¾ inch thick; and after solidification of the ingot, converting the same by hot rolling to elongated, primarily killed-steel skelp having a width of at least about 3 inches and along each of its longitudinal edges an integral zone of rimmed steel at least ½ inch wide, finishing each edge zone to a shape at least ½ inch wide, for butt welding, and completing making the pipe by shaping the skelp to cylindrical contour and electrically butt welding said edge zones together.

6. A method as defined in claim 5 in which the material added to the molten core comprises aluminum added in sufficient amount, 0.02 to 0.20% in the finished core, to kill the steel thereof.

7. A method as defined in claim 6 in which the said first-mentioned molten steel contains not more than 0.12% C and not more than 0.6% Mn, and is a rimming composition, said first-mentioned molten steel in the mold undergoing rimming action while resting before completion of pouring.

* * * * *